US009554957B2

(12) United States Patent
Manson

(10) Patent No.: US 9,554,957 B2
(45) Date of Patent: Jan. 31, 2017

(54) BED CHAIR

(71) Applicant: Wayne Smeaton Manson, Auckland (NZ)

(72) Inventor: Wayne Smeaton Manson, Auckland (NZ)

( * ) Notice: Subject to any disclaimer, the term of this patent is extended or adjusted under 35 U.S.C. 154(b) by 17 days.

(21) Appl. No.: 14/354,347

(22) PCT Filed: Oct. 24, 2012

(86) PCT No.: PCT/NZ2012/000194
§ 371 (c)(1),
(2) Date: Apr. 25, 2014

(87) PCT Pub. No.: WO2013/062423
PCT Pub. Date: May 2, 2013

(65) Prior Publication Data

US 2014/0259388 A1 Sep. 18, 2014

Related U.S. Application Data

(60) Provisional application No. 61/551,187, filed on Oct. 25, 2011.

(51) Int. Cl.

| | |
|---|---|
| ***A61G 7/002*** | (2006.01) |
| ***A61G 7/16*** | (2006.01) |
| ***A61G 7/053*** | (2006.01) |
| ***A47C 17/16*** | (2006.01) |
| ***A47C 17/17*** | (2006.01) |
| *A61G 7/018* | (2006.01) |
| *A61G 7/005* | (2006.01) |
| *A61G 7/015* | (2006.01) |
| *A61G 7/05* | (2006.01) |

(52) U.S. Cl.
CPC ..... *A61G 7/16* (2013.01); *A47C 17/16* (2013.01); *A47C 17/17* (2013.01); *A61G 7/053* (2013.01); *A61G 7/005* (2013.01); *A61G 7/015* (2013.01); *A61G 7/018* (2013.01); *A61G 2007/0514* (2013.01)

(58) Field of Classification Search
CPC ..... A61G 7/002
USPC ..... 5/600, 613, 616, 618
See application file for complete search history.

(56) References Cited

U.S. PATENT DOCUMENTS

| | | | | |
|---|---|---|---|---|
| 4,285,541 | A | 8/1981 | Onishi | |
| 2006/0021145 | A1* | 2/2006 | Hornbach | A61G 7/002 5/618 |

(Continued)

FOREIGN PATENT DOCUMENTS

| | | |
|---|---|---|
| DE | 201 08 292 | 9/2001 |
| DE | 202 15 899 | 1/2003 |

OTHER PUBLICATIONS

International Search Report, PCT/NZ2012/000194, Jun. 6, 2013.

*Primary Examiner* — Fredrick Conley
(74) *Attorney, Agent, or Firm* — Young & Thompson

(57) ABSTRACT

A bed chair apparatus has a user support surface which includes a back section 1, a seat section 14, a lower leg section 15 and a foot section 16 that are configured to articulate relative to each other. The support surface is configurable in a bed configuration in which the support surface is substantially flat and in a chair configuration in which the foot section 16 is disposed beneath the seat section 14. Some embodiments of the apparatus require only a single actuator 30.

17 Claims, 21 Drawing Sheets

(56) References Cited

U.S. PATENT DOCUMENTS

| | | | | |
|---|---|---|---|---|
| 2006/0053562 | A1* | 3/2006 | Poulos | A61G 7/16 5/722 |
| 2008/0127421 | A1* | 6/2008 | Hornbach | A61G 7/015 5/618 |
| 2012/0193946 | A1* | 8/2012 | Robertson | A47C 1/03294 297/68 |

* cited by examiner

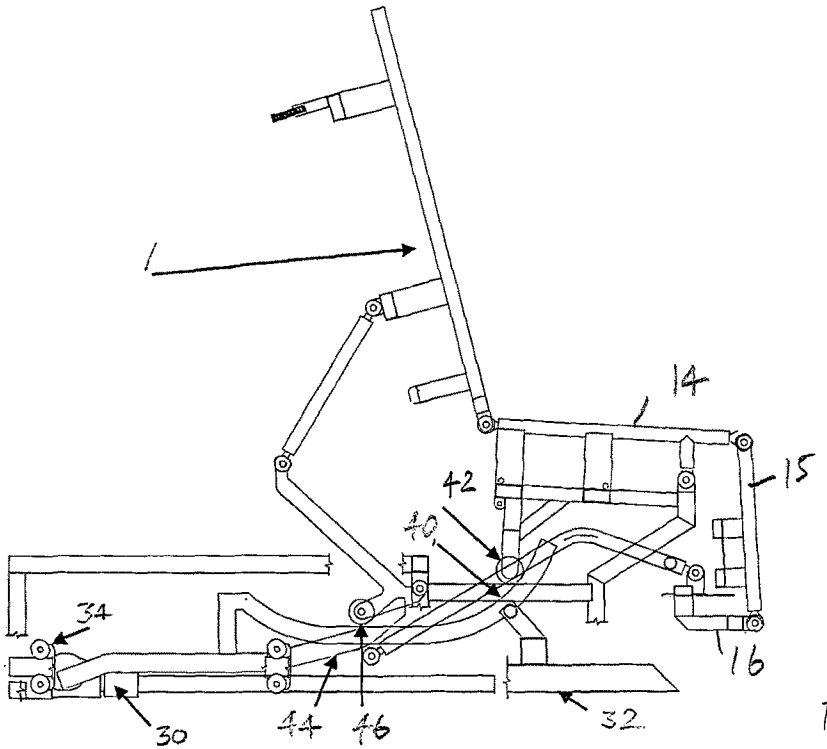

FIG 3

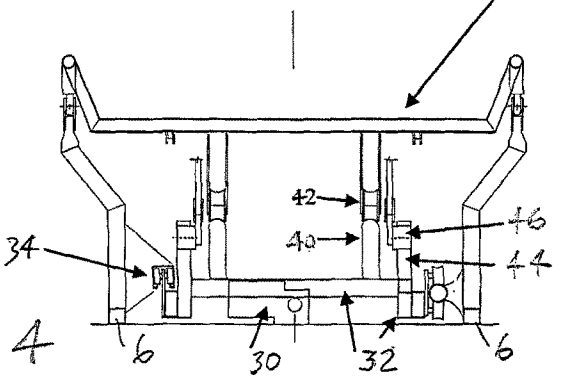

FIG 4

Alternative method of causing articulation is to use a shaped wheel (10) that runs over a tube or square section guide (11) which in this case causes the back rest to articulate.

The seat rest articulates by using wheel (12) which runs over guide (13). The guides are attached to a frame (14) which slides back and forward in either a sliding door type track (15) or shaped wheels that run on a tube (16) an actuator ( or other powered means ) (17) pushes the frame back and forward to cause the interaction between the wheel and guide which then creates the articulation of the mattress support platform.

Sleeper chair with the seat raised and tilted

Sleeper chair in the legs elevated position

PLAN VIEW SHOWING HOW THE SLOTTED PLATES COULD BE ATTACHED DIRECTLY TO THE ACTUATER

FRONT VIEW

SIDE VIEW

These drawings show how a plate with a slot in it (A) can be used to direct a wheel (B) in order to rotated arms (C & D) around a fixed pivot point (F) Such rotation causes the linked member (E) to articulate the back rest through a preferred sequence of motion This drawing shows how the slotted plate (H) guides the wheel (I) which causes arms ( J & K ) to pivot about fixed point (F)
The slot ( L ) in arm ( K) allows the wheel ( M ) to track back and forward as arm ( K ) causes seat section ( N ) to pivot around point ( O )

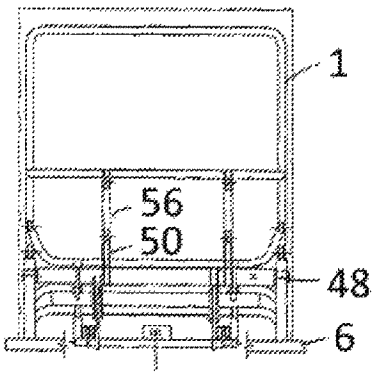
FIG 14
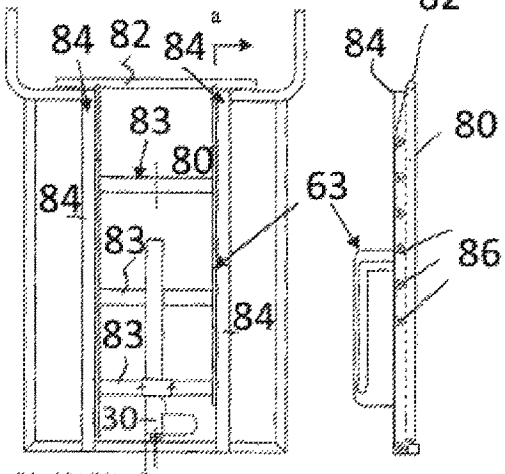
FIG 15
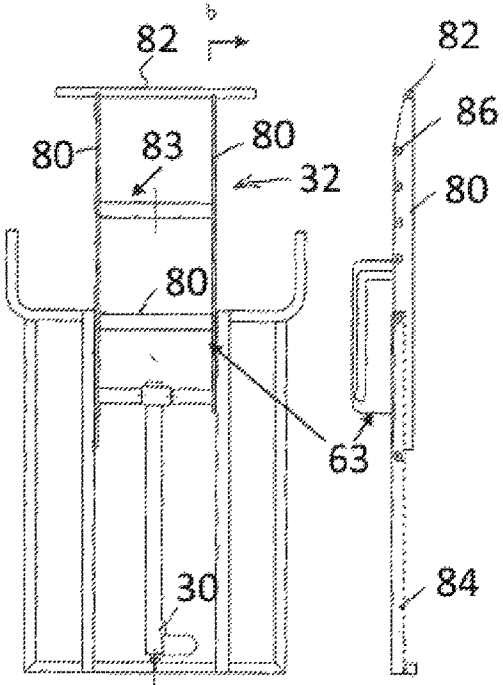
FIG 16
FIG 17
FIG 18
This shows how that slotted plates (18) could be attached to a sliding frame (19) attached to sliding tracks (16&17) which would mean the slotted plates could be spaced further apart and kept more stable.

This is a special moulded hinge joint made to fit in the 25 mm OD side tubes of the mattress support platform

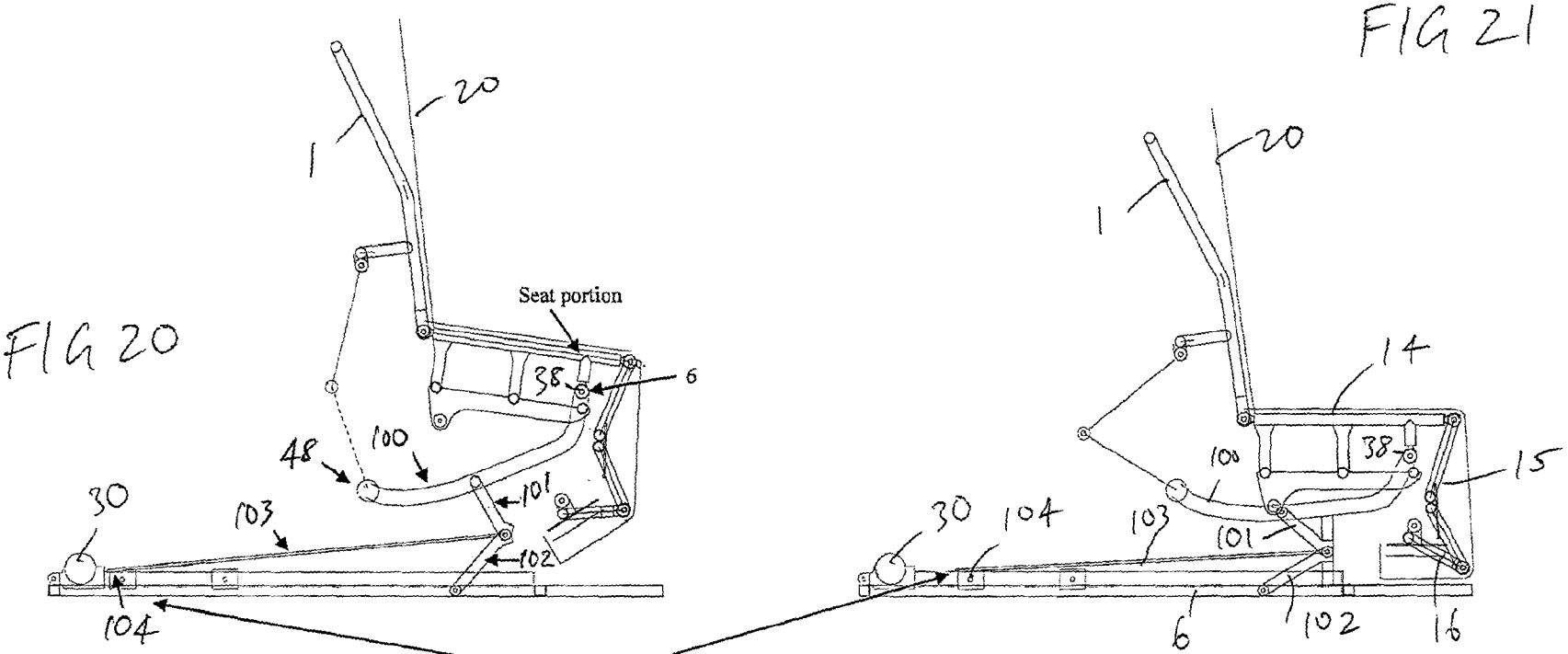

This drawings how the seat is lifted
As the actuator carriage block ( 5 ) nears the end of its stroke a stirrup frame ( 4 ) engages with the cartridge. This action is timed at the appropriate sequence to cause a lifting action in the seat portion by pulling on stirrup (4) which causes linked lever arms (3&2) to spread and therefore lift arm ( 1 ). Arm (1) pivots around fixed point ( f ) and links to the seat portion at pivot point (6)

HOW THE BACK REST ARTICULATES
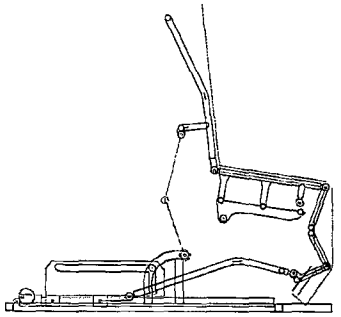
1/. EXCIT POSSITION
FIG 22A
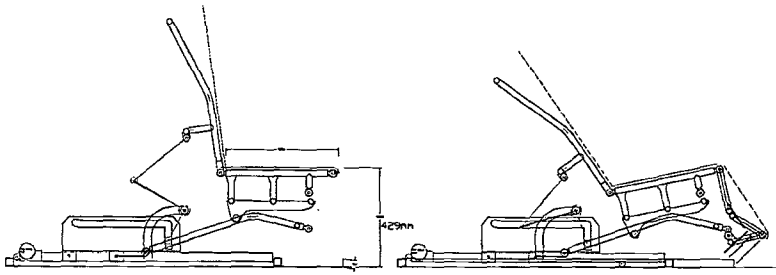
2/. ENTRY POSSITION
FIG 22B
3/. RECLINED POSSITION
FIG 22C
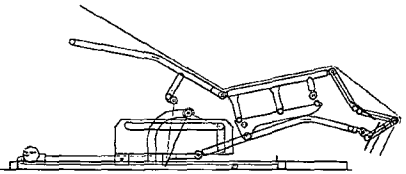
4/. RECLINED (2) POSSITION
FIG 22D
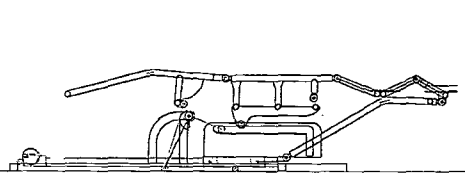
5/. RECLINED (3) POSSITION
FIG 22E
6/. BED POSSITION
FIG 22F
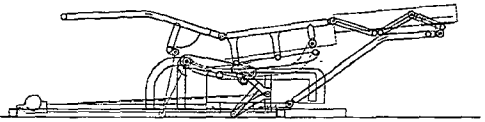
7/. LEG ELEVATED POSSITION
FIG 22G HOW THE SEAT REST ARTICULATES
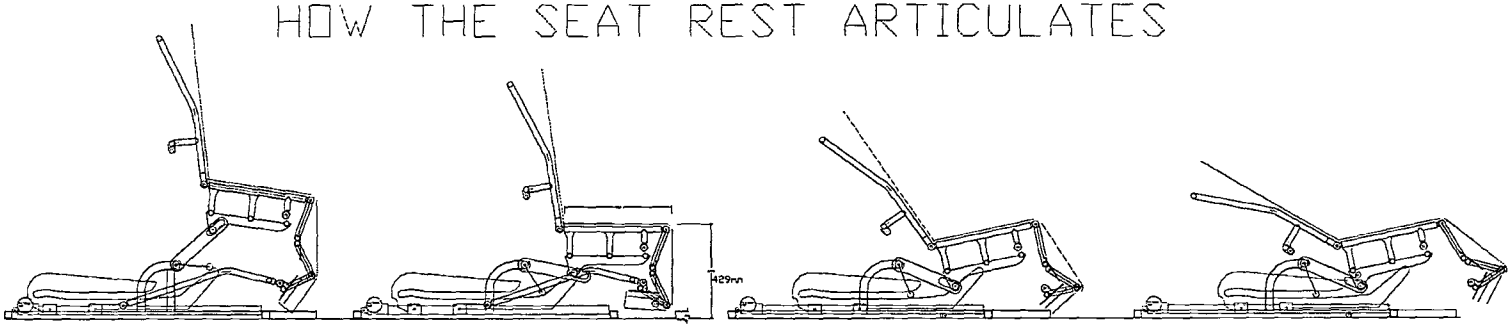
FIG 23A
FIG 23B
FIG 23C
FIG 23D
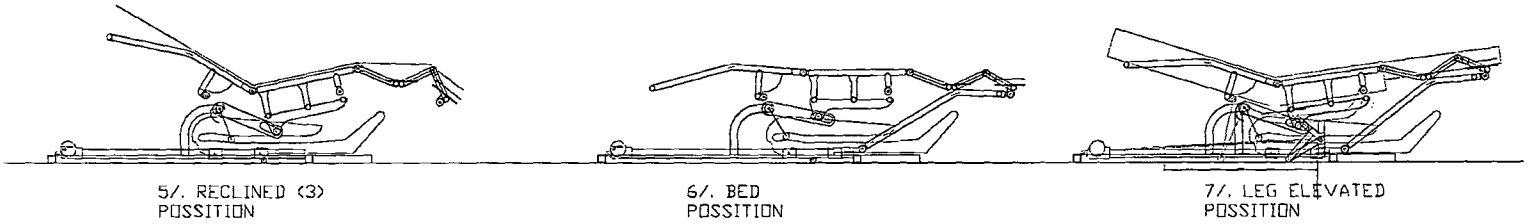
FIG 23E
FIG 23F
FIG 23G

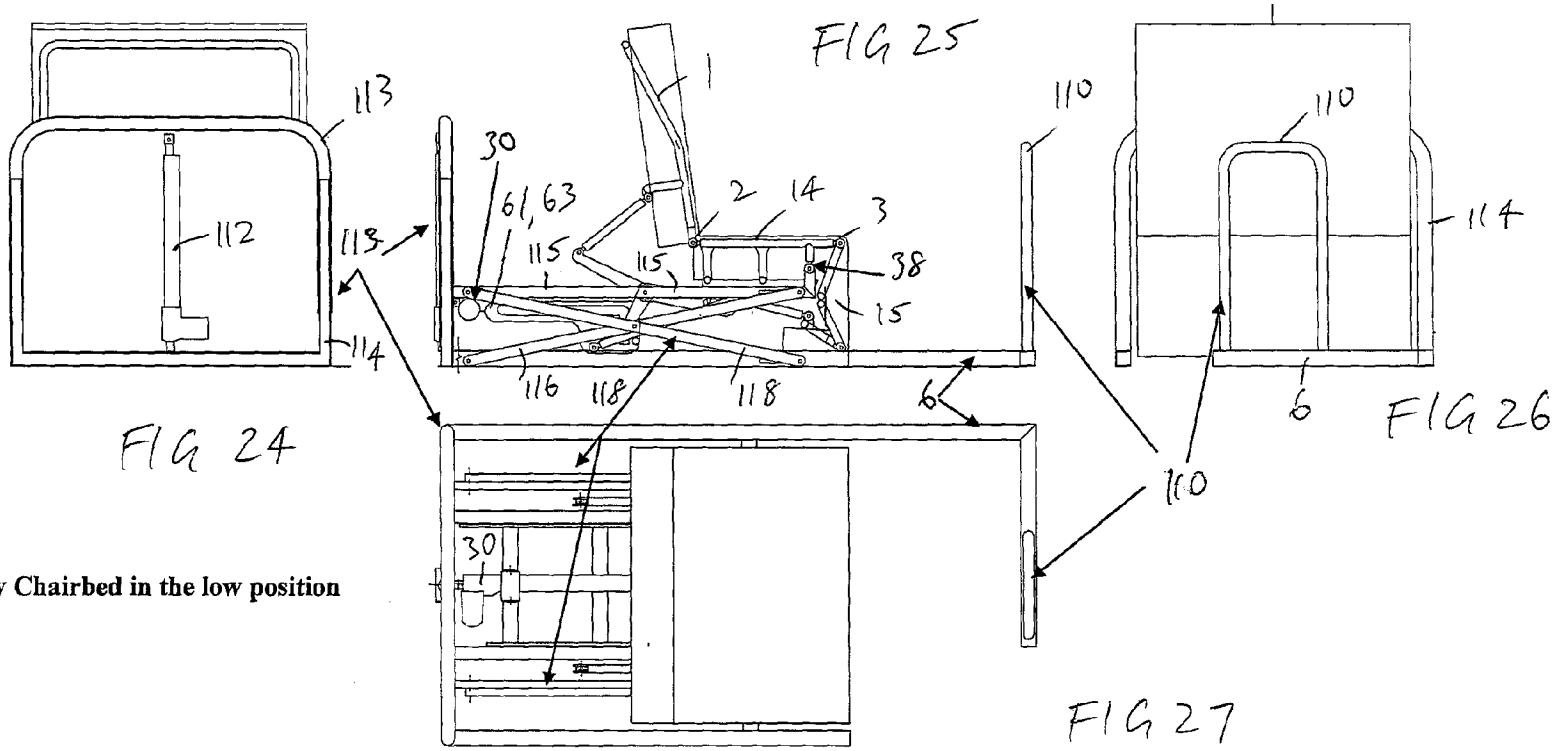

Hi Low Chairbed in the low position

This drawing details another method we could use to raise and lower the Bedchair. CLAIM the slotted plates and actuator hang upside down (1). CLAIM The base extends forward and hooks around the front (2) to prevent over balancing as the high low function means we cant use the sliding frame to prevent overbalancing. CLAIM Optionally a second actuator could drive a sliding frame to prevent overbalancing but would need to be independent of the second sliding frame which has the slotted plates. CLAIM an actuator drives a telescopic frame (3)up and down which in turn makes a scissor arrangement (4) lift and lower the bed CLAIM a handrail (5) extends up from the hooked base frame. CLAIM the seat portion pivot point is not at the knee joint but set back at (6)

Hi Low Chairbed in the high position

CLAIM Right hand entry to the Bedchair is from the open side (7).
CLAIM Left hand entry would be from a left hand configuration so the entry is on the other side. Alternatively The base frame could be reversed over and the handrail re bolted to suit

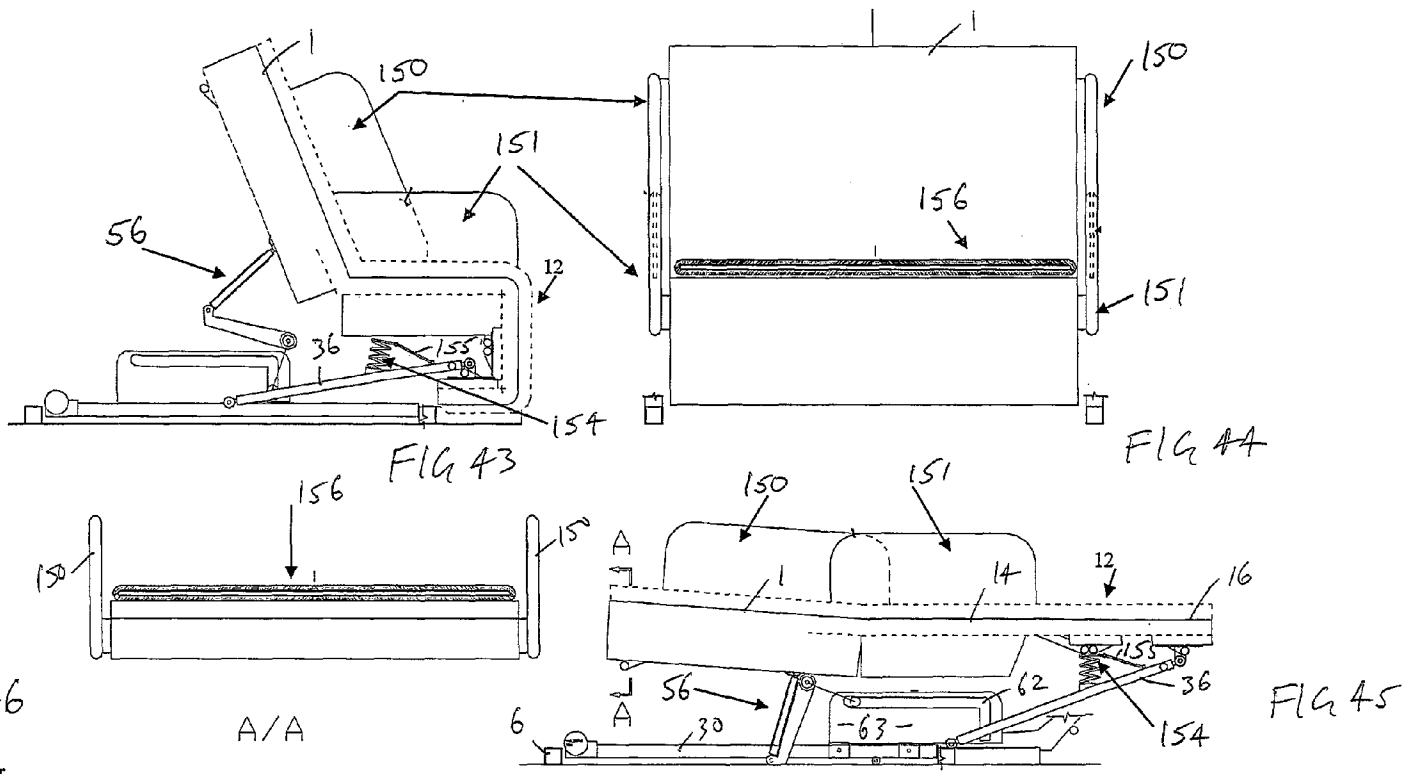

Bariatric Bedchair

The mattress is deeper overall but there remains a problem with being able to have the leg and foot rest tin enough t bend while still be able to support really heavy legs in comfort.

CLAIM the leg rest support bar (99) has a spring or other suspension mechanism which touches under the leg rest when the leg rest support bar is fully extended. On top of the spring is a plate which hinges back to the leg rest support bar to keep the spring in a vertical position.

Because of extra fat on the client belly and bottom, Bariatric client are no able to sit upright properly CLAIM link bar (8) is telescopic to allow the back rest to be adjusted to suit the angle the client can sit at.

Rolling onto their side can be really difficult so CLAIM there are handrails which double as telescopic Cot side rails on the seat (9) and back rest (10) either side. Such rail telescope into each other (11) in order to create a continuous barrier at all times. Optionally the handrails are padded

Optional

- Thin Mattress with inner slide sheet tube fixed centrally to the mattress. (12) which aids repositioning in bed. When rolling onto their side shear forces prevent them from rolling and so CLAIM a tube of slippery material ( Slide sheet ) aids repositioning. Fixed to the perimeter of a slide sheet is a thin mattress. This is fixed centrally to the main mattress and fixed to the edges with elastic to keep it in place. While slide sheets are not new the method of padding it to a point where it is a thin mattress and fixing it to the main mattress is new.

BED CHAIR

FIELD OF THE INVENTION

This invention relates to a piece of resting furniture and has particular relevance to a bed which is convertible to a chair or chair-like configuration.

BACKGROUND

Many people, particularly disabled people, find it difficult getting in and out of bed. The reasons for this are many but include:

a) general muscle weakness because of age, sickness, disease, low mental ability or balance, obesity; and
b) inability or difficulty of movement because of surgery, hip replacement or back injury.

Caregivers for this type of patient also have problems with caring for the patient. Among their concerns are manual handling injury caused by helping the patient in and out of bed and back injuries from having to stoop over a low bed when tending to a patient. Surface shear on the patient skin as the patient is being transferred on and off the bed, or as the mattress profiles under the body of the patient, can also be an issue.

Existing solutions include:

1. Powered Leg Lifters

These work with some people but many people cannot use them because:

a) they lack the required muscle strength to balance on the bed as their feet are being raised;
b) they cannot use the handset controller that is typically required for use of the product;
c) they do not have the ability to move their feet off the leg lifter foot rest and onto the bed; and
d) they do not like the appearance of the leg lifter beside their bed.

2. Chair Beds

These are basically recliner chairs with a mattress topper pad for extra comfort. Some chair beds have additional width to simulate a bed and some are made with customized seat depth and height to suit the user's posture and stature.

Chair beds work with some people but many people cannot use them because:

a) the mattress platform does not lie completely flat and therefore they are not able to roll onto their sides for comfort while sleeping;
b) the mattress platform is always too short. This is because the seat height determines the length of the leg rest. When the leg rest raises to the horizontal position their feet are left hanging over the end of the leg rest and are therefore unsupported;
c) the chair bed looks like a chair and not a bed and therefore can be rejected as a bedroom item; and
d) the chair bed is a fixed height and is therefore at a very low position for care giving tasks.

3. Bed Chairs

These typically provide a full bed which is convertible into a chair-like form. The disadvantages include:

a) poor ergonomic design which make them very uncomfortable to sit in and use;
b) the motors are slow and work independently which means users have to know which button to push and for how long in order to get the sit to lie action working properly;
c) they are very heavy to transport; and d) some try to solve the problem of the feet hanging over the end of the mattress by providing a foot plate which rises with the leg rest and prevents a user's feet coming off the end of the mattress, but the result is that the patient's body is either pushed up into the mattress or their legs become bent. When in the lie flat position their feet also end up being pushed hard against the foot rest which can be cold and uncomfortable.

4. Inflatable Chairs:

a) these are designed to hoist a person into and therefore do not support independent transfer on and off the bed;
b) they do not lie completely flat; and
c) feet are typically left unsupported when in the horizontal position.

The reference to any prior art in the specification is not, and should not be taken as, an acknowledgement or any form of suggestion that the prior art forms part of the common general knowledge in any country.

OBJECT

It is an object of the present invention to provide a resting apparatus such as a bed or bed chair which will overcome one or more of the foregoing disadvantages. Alternatively, it is an object of the present invention to at least provide the public with a useful choice.

SUMMARY

According to one aspect of the present invention there is provided a bed chair apparatus including:

a frame;

a user support surface supported by the frame, the user support surface including a backrest section, a seat section, and a leg section that are configured to articulate relative to each other whereby the user support surface is configurable in a bed configuration in which the support surface is substantially flat and in a chair configuration;

at least one profile member having a contoured surface and a follower which is guided by the contoured surface whereby movement of at least one of the backrest section or the seat section relative to the frame is dependent on the contour of the contoured surface.

The profile member may be provided on the frame. The follower may be connected by a link to the backrest section or the seat section.

In one embodiment the profile member is provided to control movement of the backrest section relative to the frame, and a further profile member is provided to control movement of the seat section relative to the frame.

A biasing means may be provided to maintain the follower in contact with the contoured surface.

In one embodiment the contoured surface is provided in a slot in the profile member.

In another aspect the invention provides a bed chair apparatus including:

a frame;

a user support surface supported by the frame, the user support surface including a backrest section, a seat section, a leg section and a foot section that are configured to articulate relative to each other whereby the user support surface is configurable in a bed configuration in which the support surface is substantially flat, and in a chair configuration and wherein the leg section is only connected to the frame via pivotal connection to the seat section and the foot section.

In yet another aspect the invention provides a bed chair apparatus including:

a frame;

a user support surface supported by the frame, the user support surface including a backrest section, a seat section, a leg section and a foot section that are configured to articulate relative to each other whereby the user support surface is configurable in a bed configuration in which the support surface is substantially flat and in a chair configuration; a link between the frame and the foot section to move the foot section between the bed configuration and the chair configuration, wherein the link supports the leg section when the apparatus is in the bed configuration.

In yet another aspect the invention provides a bed chair apparatus including:

a frame;

a user support surface supported by the frame, the user support surface including a backrest section, a seat section, a leg section and a foot section that are configured to articulate relative to each other whereby the user support surface is configurable in a bed configuration in which the support surface is substantially flat and in a chair configuration; a link between the frame and the foot section to move the foot section between the bed configuration and the chair configuration; a stop member which stops movement of the link in at least one direction as the apparatus articulates from the bed configuration to the chair configuration.

In one embodiment the stop member redirects movement of the link to articulate the foot section relative to the leg section.

In yet another aspect the invention provides a bed chair apparatus including:

a frame;

a user support surface supported by the frame, the user support surface including a backrest section, a seat section, a leg section and a foot section that are configured to articulate relative to each other whereby the user support surface is configurable in a bed configuration in which the support surface is substantially flat and in a chair configuration; and wherein during articulation from the chair configuration to the bed configuration the leg section commences articulation prior to the foot section.

In yet another aspect the invention provides a mattress for a bed chair apparatus, the mattress including a plurality of foam panels having ends located substantially adjacent to each other, and a sheet of non-stretch material provided attached to the panels and spanning the adjacent panel ends.

According to a further aspect of the present invention there is provided a bed chair substantially as herein described with reference to any one or more of the accompanying examples and/or figures.

In another aspect the invention provides any new feature or new combination of features described herein.

Further aspects of the invention, which should be considered in all its novel aspects, will become apparent from the following description given by way of example of possible embodiments of the invention.

DRAWING DESCRIPTION

Embodiments of the invention will be described below with reference to the accompanying drawings, in which:

FIG. 1: is a perspective view of a first embodiment of the bed chair according to the invention in a chair configuration;

FIG. 2: is a partially exploded perspective view of the embodiment of FIG. 1 showing a mattress construction when the apparatus is in a bed configuration.

FIGS. 3 and 4: are side and end elevations respectively of another embodiment of a bed chair apparatus.

FIGS. 5 and 6: are perspective views of another embodiment of bed chair apparatus in a chair configuration and a bed configuration respectively.

FIG. 7: shows a side elevation of the embodiment of FIGS. 5 and 6.

FIG. 8: shows a rear elevation of the embodiment of FIGS. 5 and 6.

FIG. 9: is a plan view of the embodiment of FIGS. 5 and 6.

FIG. 10: is a side elevation (from the other side) of the embodiment of FIGS. 5 and 6.

FIG. 11: is a front view of the embodiment of FIGS. 5 and 6.

FIG. 12: is a partial side elevation of the embodiment of FIGS. 5 and 6 to illustrate articulation of the back section.

FIG. 13: is a partial side side elevation of the embodiment of FIGS. 5 and 6 to illustrate articulation of the seat section.

FIG. 14: is an end elevation of an alternative frame and carriage construction for the embodiment of FIGS. 5 and 6.

FIG. 15: is a plan view of the embodiment of FIG. 14 with the carriage in the retracted configuration.

FIG. 16: is a partial side elevation in cross section of FIG. 15.

FIG. 17: is a plan view of the embodiment of FIG. 14 with the carriage in the extended configuration.

FIG. 18: is a partial side elevation in cross section of FIG. 17.

FIG. 19: shows a perspective view of a hinge construction for use with the bed chair apparatus of the invention.

FIGS. 20 and 21: illustrate partial side elevations of the embodiment of FIGS. 5 and 6 to illustrate controlling height of the seat section during articulation of the apparatus.

FIGS. 22A-G: illustrate articulation of the backrest section of the embodiment of FIGS. 5 and 6.

FIGS. 23A-G illustrate articulation of the seat section of the embodiment of FIGS. 5 and 6.

FIGS. 24-27: illustrate front, side, rear and plan views respectively of a further embodiment of bed chair apparatus in a lowered chair configuration.

FIGS. 28-30: illustrate front, side and plan views respectively of the embodiment of FIGS. 24-27 in a raised bed configuration.

FIGS. 31-35: are partial side elevations in cross section of a further embodiment of a bed chair illustrating a sequence of articulation from a chair configuration to a bed configuration.

FIGS. 36-39: are front, side, end and plan views respectively of a further embodiment showing the bed chair apparatus in a raised bed configuration.

FIGS. 40-42: are side views of the embodiment of FIGS. 36-39 in different height configurations.

FIGS. 43 and 44: are a side view and front view of a further embodiment in the chair configuration.

FIG. 45: is a side view of the embodiment of FIGS. 43 and 44 in a chair configuration.

FIG. 46: is a partial cross section through FIG. 45.

BEST MODES FOR PERFORMING THE INVENTION

In one embodiment a bed chair is provided having a user support surface such as a bed mattress with an integrated and supporting base mechanism which can be shaped either with powered actuators or by manual adjustment between a bed configuration and a chair configuration, to assist a user with moving from sitting to lying and sitting to standing.

Where possible in the following description, like reference numerals are used to designate like features between the various embodiments described. Those skilled in the art will appreciate that features of some embodiments may be interchanged with, or added to, features of other embodiments.

Referring to FIG. 1, a bed chair is shown in side elevation having a base frame 6 which supports an articulated frame 7 on or about which a mattress (not shown) is in use mounted.

The mattress can be provided in a range of mattress qualities, including single and or multi-layered polyurethane foam with or without profile shaping of the surface, also memory foam or latex rubber. Thus the user has a choice of comfort and/or pressure care. In one embodiment the mattress is covered with breathable elastic waterproof material, preferably polyurethane or PVC, such as that sold under the trade mark CARRFLEX.

The frame 7 can include base support members 9 to support the base of the mattress, at least at the back rest and seat portions of the frame 7. The mattress has an upper surface that provides a user support surface comprising a number of sections. Section 1 is a back rest section, section 14 is a seat section, section 15 is a lower leg rest section and section 16 is a foot rest section. The articulated frame 7 may be moved either manually or through the use of powered actuators (as will be described further below) to move the user support sections relative to each other to provide a bed configuration or a chair configuration and/or other configurations that may be required by the user.

In the embodiment illustrated in FIG. 1, the articulated frame 7 is disposed inside the mattress, adjacent to the perimeter. Those skilled in the art will appreciate that the mattress may be attached to the frame 7 using other arrangements. The articulated frame 7 is constructed of steel in the embodiment shown but may be constructed from other materials having appropriate properties such as plastic, aluminium or fibreglass for example. The frame 7 includes a number of sections that are pivotally connected to each other at pivot connections 2, 3 and 4.

In a conventional profiling bed arrangement the pivot connections would be located below the mattress. However, in the embodiment shown in FIG. 1, the pivot connections are located at least above the lower level of the mattress, and preferably adjacent to the upper surface of the mattress that supports the user. We have found that this arrangement in which the pivot connections are provided nearer to the upper surface of the mattress means the upper surface of the mattress does not creep as articulated frame 7 moves in use. This is helpful, particularly where the foot section of the leg rest area folds under the seat section, as will be described further below. The mattress and the frame 7 need to stay in the same plane in order to have the foot section fold under tightly. For the user, less mattress surface creep means less shear forces on the skin, providing better pressure care.

In some embodiments (not shown) the back rest section 1, seat section 14, lower leg rest section 15 and foot rest section 16 may all be separate foam mattress sections. These sections may then be overlaid with a continuous layer of softer foam, which may be easier to bend in order to accommodate the changes in shape of the bed chair. This improves the flexibility of the mattress, particularly around the foot rest and leg support portions, and reduces the tendency for the back rest section of mattress to be pulled away from the frame when the foot rest and leg support sections are folded, thereby allowing the user to sit back into the chair.

An elastic material may be provided to span the gaps between the separate mattress sections, providing support for the soft foam layer, while remaining flexible enough to be bent into the different positions required. The mattress cover may also be provided with connecting means, such as a zip, which allows the top part of the cover to be removed from the bottom half, thereby facilitating replacement of the mattress.

In the embodiment shown in FIG. 2 the mattress 20 comprises a number components which are assembled together and mounted on support surfaces 9 and 9A provided on parts of frame 7. The mattress 20 includes soft foam cushioning panels 20B-20D which are placed together and layered within a mattress cover or sleeve 20A. Within the mattress structure a sheet 20E of non-stretch fabric is provided. This may be constructed from a plastic material such as flexible nylon sheeting or canvas. The sheet 20E is used to span the discontinuities or gaps between the end of one foam panel and the beginning of another and may be conveniently glued in place by gluing to the foam panels that surround it. Sheet 20E also serves to provide support to the foam layer above the sheet 20E. Therefore, the sheet 20E provides support to the mattress structure when pressure is applied from above, especially pressure on or adjacent to the gaps between panels, such as a user kneeling on the mattress for example. Without sheet 20E a user's knee could tear through the mattress structure.

The rear portion of the backrest section 1 may be covered with an appropriate backing such as an upholstered board arrangement referenced 21 in FIG. 2. Similarly, the sides of the base 6 may be covered with an upholstered board or moulded plastic sheeting or timber panelling arrangement 22, also shown in FIG. 2. Such coverings are desirable for aesthetic purposes, but also have the advantage of preventing unwanted interference with the mechanical assembly, for example preventing a user getting a limb trapped in the frame in use.

As mentioned above, the bed chair is capable of articulating between a bed configuration and a chair configuration. In FIG. 2 the apparatus is in a bed configuration. In FIG. 1 the apparatus is in a chair configuration. Referring to FIG. 1 articulation between configurations occurs through movement controlled by actuator 30 which moves a sliding carriage or sub-frame 32 that slides relative to frame 6 by means of wheels or rollers 34.

Links 36 are pivotally mounted between the carriage 32 and the foot rest 16, so as the carriage 32 is extended and retracted, so the footrest 16 is extended and retracted. As Footrest 16 is extended from the position shown in FIG. 1, the lower leg rest section 15 to which it is pivotally connected by hinges 3 and 4 also extends. Simultaneously, the rear part of seat section 14 begins to rotate downwardly about hinges 38 as wheels or rollers 42 follow the contour of carriage frame seat profile members 40 which extend from the frame 6 with movement of the carriage 32. Carriage frame backrest profile members 44 also move with the carriage 32. Wheels or rollers 46 follow the contour of profile members 44, acting through arms 47 to cause links 50 to pivot about pivot points 48. This in turn causes links 56 to move the backrest section downwardly via the hinges 52 and 54. Optionally, coil springs 51 ensure that the wheels 42 and 46 remain in contact with the contoured frame members 40 and 44. The action continues until the frame 7 has articulated to the extent that the mattress provides a substantially flat user support surface.

Turning now to FIGS. 3 and 4, another embodiment is shown. In this embodiment the profile members 40 and 44 of the previous embodiment have a slightly different contour but the features are essentially the same. The variation this contour provides a variation in the motion of the sections as the bed chair articulates from one configuration to another.

Turning now to FIGS. 5 and 6, perspective views of another embodiment are shown. FIGS. 7-11 show side, rear, plan, other side, and front views respectively. This embodiment has a lighter base frame 6, but those skilled in the art will appreciate that an expanded or reinforced base frame structure such as that used in previous embodiments may be used. In this embodiment the profile members 40 and 44 of the previous embodiment are provided, at least in part, in the form of slots. In this embodiment, slot 60 in plate 61 controls articulation of the seat section 14, and slot 62 in plate 63 controls articulation of the backrest section 1. For purposes of consistency with the previous embodiment, the follower within slot 62 is labelled 46. Articulation of the seat portion in this embodiment uses two followers as described further below.

The articulation of the embodiment of FIGS. 5 and 6 is further described with reference to FIGS. 12 and 13. For clarity, FIGS. 12 and 13 show an arcuate structural member 49 being used to support fixed pivot point 48. Those skilled in the art will appreciate that frame arrangements other than those specifically illustrated herein may be used to effect the arrangement of pivot points and links that facilitate the articulation described.

FIG. 12 shows, in diagrammatic form, further detail of the articulation mechanism for the backrest section 1. As can be seen in FIG. 12, the actuator 30 moves carriage 32 relative to the frame 6. The carriage may take different forms. In this embodiment it is essentially the movable part of the actuator. The plate 63 which provides contoured slot 62 is provided on carriage 32. Therefore, as the carriage moves toward the foot section 16 as shown in FIG. 6, arms 36 extend the foot section and the position of follower 46 relative to the stationary pivot point 48 is controlled by the contour of the slot 62. Follower 46 is initially guided by the vertical portion of slot 62 as the carriage extends toward the foot section 16 which rotates arm 47 around pivot point 48 to begin lowering the backrest section 1. The converse occurs upon the carriage being withdrawn back away from the foot section 16.

FIG. 13 shows, in diagrammatic form, further detail of the articulation mechanism for the seat section 14. For purposes of consistency with the previous embodiment, the first follower located at the lower rearward part of the seat section 14 is referenced 42. Follower 42 follows the contour at the mouth of slot 60 and can also slide within slot 65 of arm 68. Arm 68 pivots about fixed pivot point 48 and is rigidly fixed to arm 70 which also pivots about pivot point 48. The end of arm 70 that is remote from the pivot point 48 carries follower 72, which follows the contour of slot 60. As can be seen in FIG. 13, plate 61 is provided on movable carriage 32, so as the actuator 30 moves the carriage away from footrest section 16, the follower 42 is directed upwardly which raises the rear part of the seat section by causing it to pivot about fixed pivot point 38. The slot 65 allows the follower 42 to move relative to arm 68 as necessary during the seat articulation sequence.

FIG. 12 shows that the leg rest section 15 has no linkage or control member which controls its movement relative to the frame 6. Instead, the adjacent pivot connections 3 and 4 are all that are required to control its movement during the articulation process from one configuration to the other. Furthermore, the footrest control/linkage arm 36 is contoured to provide an elbow contact area 55 (refer to FIGS. 6, 22F and 23F) to support the leg rest 15 from below when in the chair configuration. This provides enhanced support to the leg rest section 15. Arm 36 can be provided with alternative means to support the leg rest section 15. For example, arm 36 may be provided with a shoulder or similar projection that projects from a central part of the arm.

FIG. 6 also shows a stop member 51 which stops downward movement of arms 36 at a certain point during articulation to the chair configuration. Once that point is reached, the arms 36 contact stop member 51 which directs the arms rearwardly, assisting the footrest section 16 to fold back and upwardly under the seat section 14.

Referring now to FIGS. 14-18 partial views another embodiment are shown in which the base frame is altered for increased stability and supports an expanded carriage structure. Thus in FIG. 15 it can be seen that the carriage 32 includes to side members 80 that are joined by cross members 82 and 83. The side members 80 are slideably mounted on or in frame members 84 suing wheels or rollers 86 in this example. Plate 61 is attached to one side member 80 and plate 63 is attached to the other side member. The end member 83 extends beyond the width of the carriage for increased stability when the carriage is extended, and thus assists in preventing the apparatus from tipping over when weight is applied to the foot of the apparatus when it is in the bed configuration. In this embodiment and in other embodiments a wheel or roller may be provided on end member 83 of the carriage (or at the ends of side members 80) to assist in preventing the end of the carriage catching on any part of the surface over which it travels during articulation of the apparatus. The wider carriage structure of this embodiment generally enhances stability.

FIG. 19 shows a perspective view of a hinge construction 90 for use with the bed chair apparatus described herein. The hinge 90 may be moulded from a plastics material such as lubricated PETP (polyethylene terephthalate) or lubricated Acetol. Ends 91 and 92 have an outside diameter adapted to locate with metal tubing that may be used to construct the bed chair frames. In a preferred embodiment the bed chair frame is made from 25 mm OD tubing. Hinge 90 can be used to provide pivot or hinge points 2, 3 and 4 for example. Legs 93 of hinge end 91 straddle central hinge portion 94 of hinge part 92. A hinge pin 95 engages parts 93 and 94 so that they are held together yet may move angularly relative to each other.

Turning now to FIGS. 20 and 21 a mechanism for adjusting the height of seat portion 14 is shown. One end of arm 100 provides pivot point 38 for the front of the seat portion 14. The other end of arm 100 is pivotally connected to fixed pivot point 48. One end of each link 101 and 102 is pivotally connected to one end of rod 103. The other end of link 101 is connected to arm 100. The other end of link 102 is connected to the base frame 6. The other end of rod 100 is pivotally connected to the rear part of carriage 32 (or to a separate movable part of the actuator) at point 104 so that as the carriage is moved toward the footrest section 16 the links 101 and 102 fold together to lower the arm 100 and thus lower the seat section. Similarly, as the carriage is moved away from the footrest section 16 the seat section is raised.

FIGS. 22A to 22G illustrate the articulation sequence for the backrest section 1 for the embodiment described above with reference to FIGS. 5-8.

FIGS. 23A to 23G illustrate the articulation sequence for the seat section 14 for the embodiment described above with reference to FIGS. 5-8.

Figure 1:
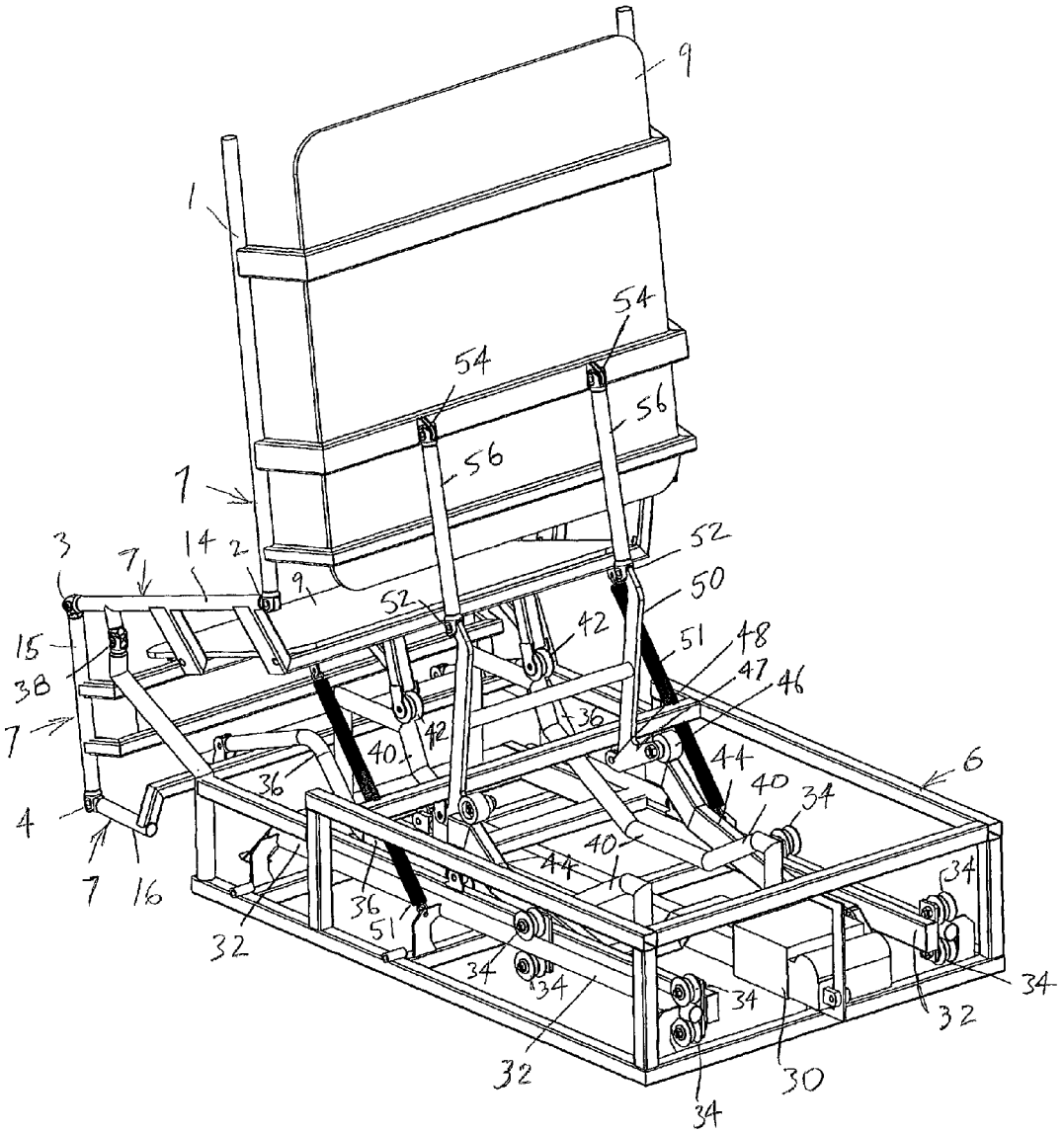
Figure 2:
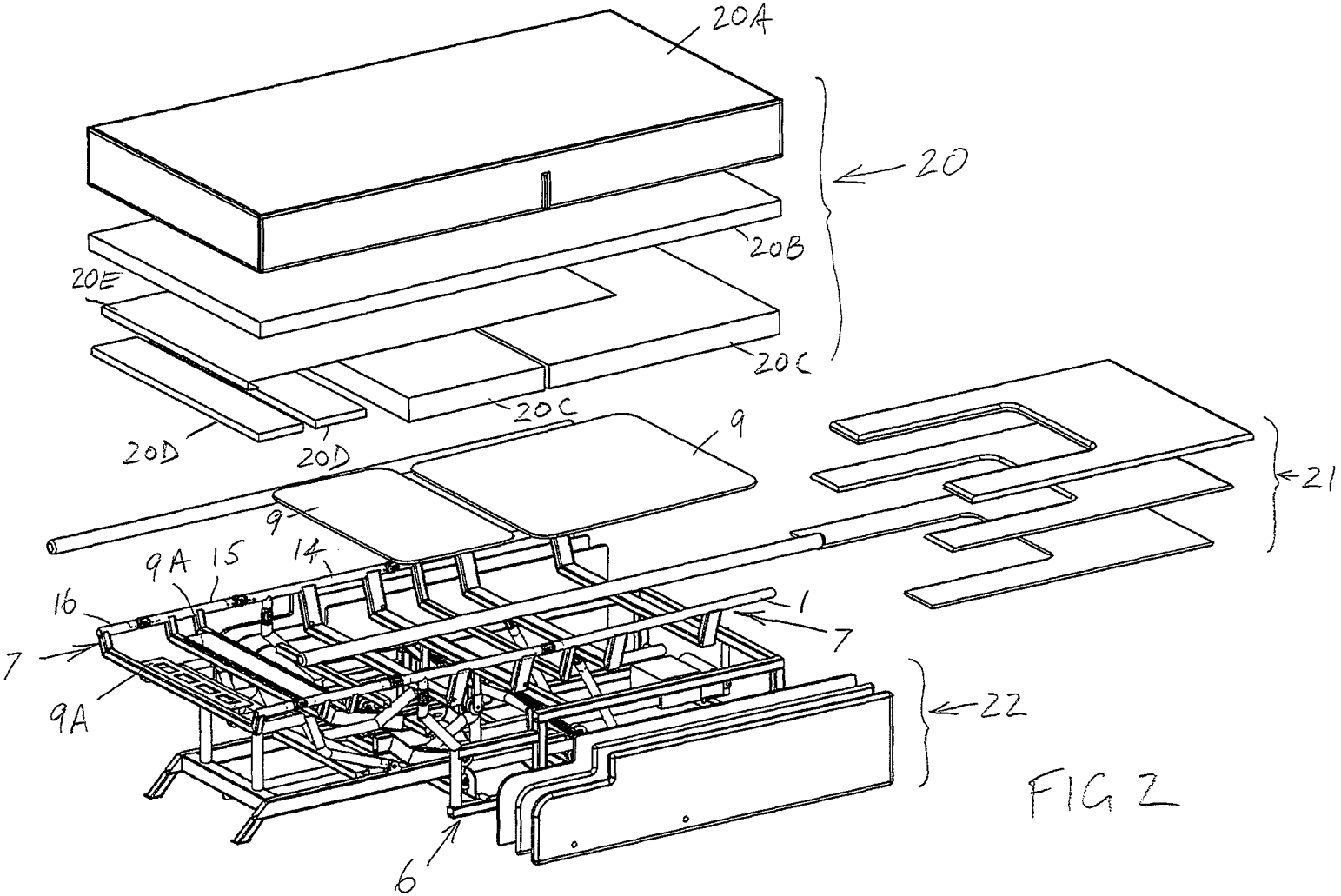
Figure 5:
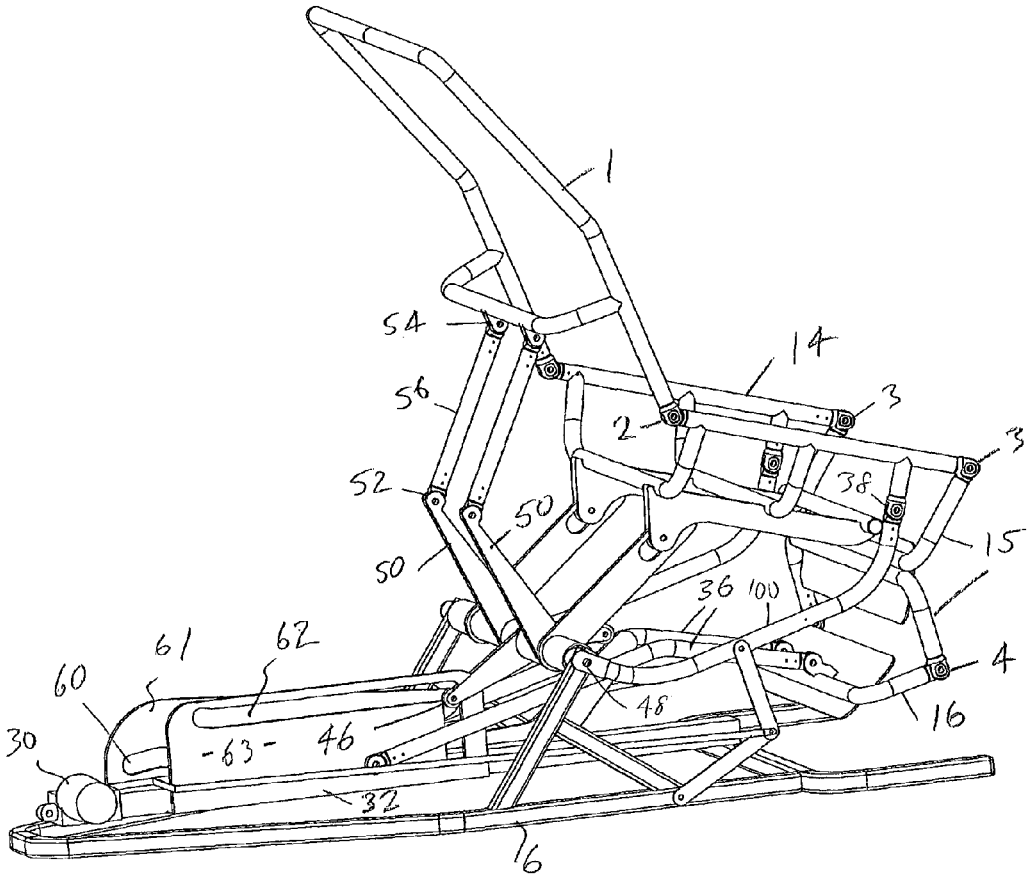
Figure 6:
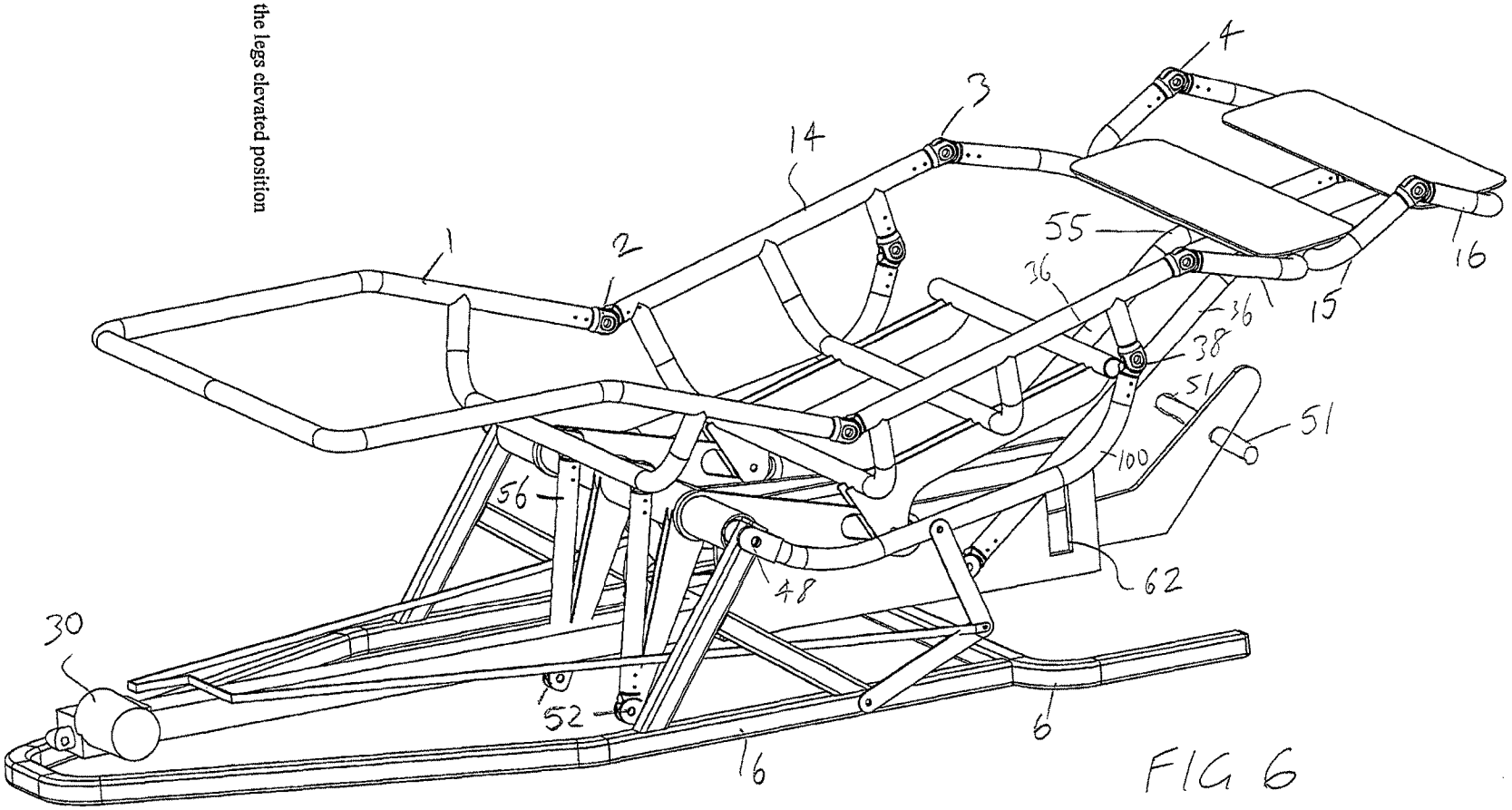
Figure 8:
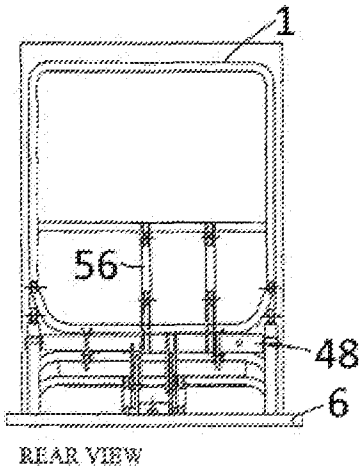
Figure 7:
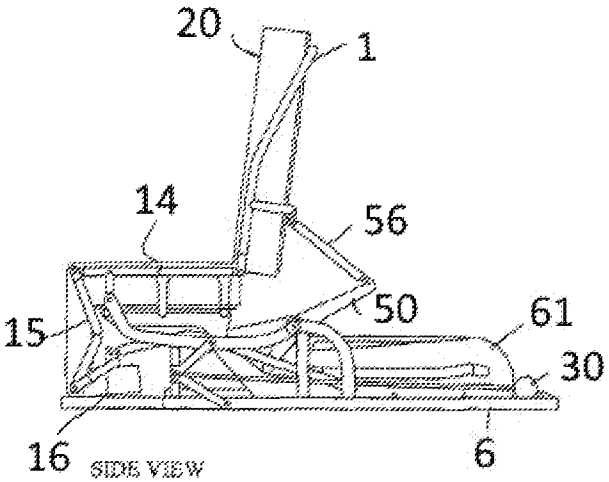
Figure 9:
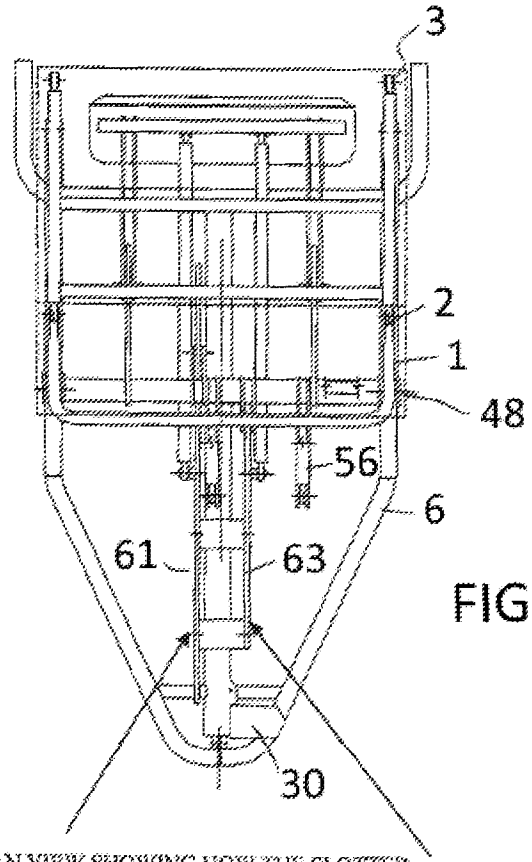
Figure 11:
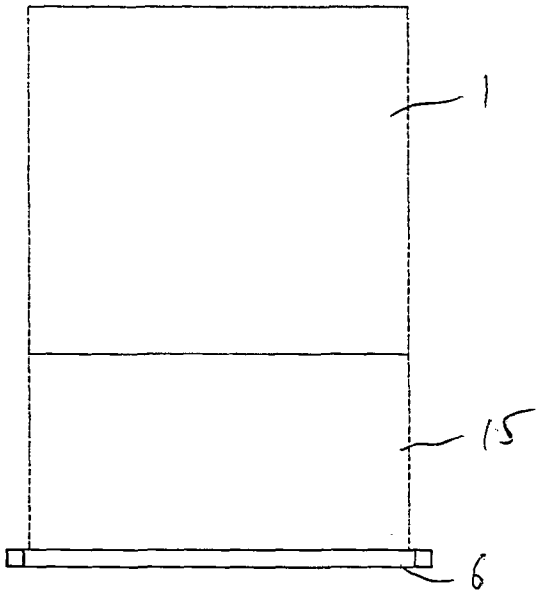
Figure 10:
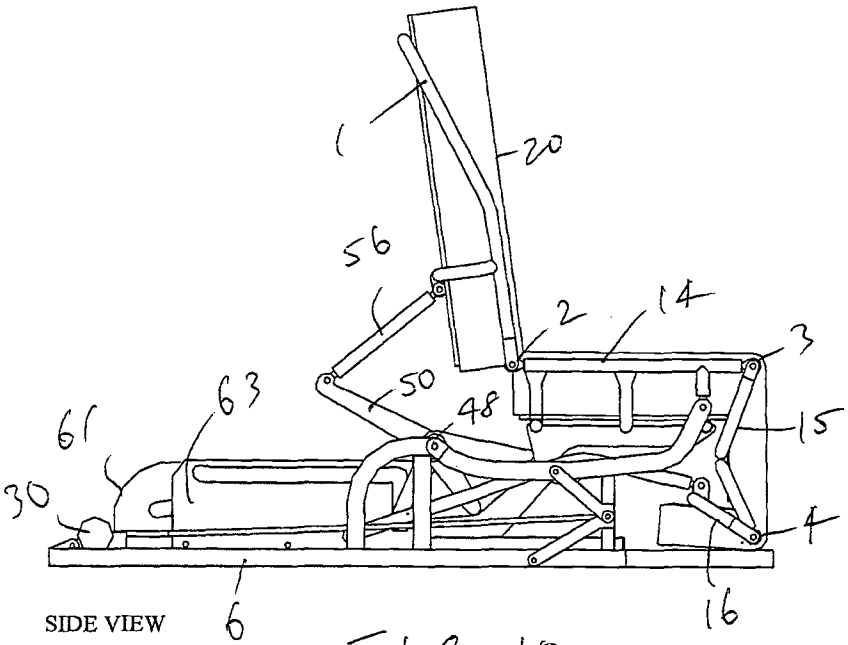
Figure 12:
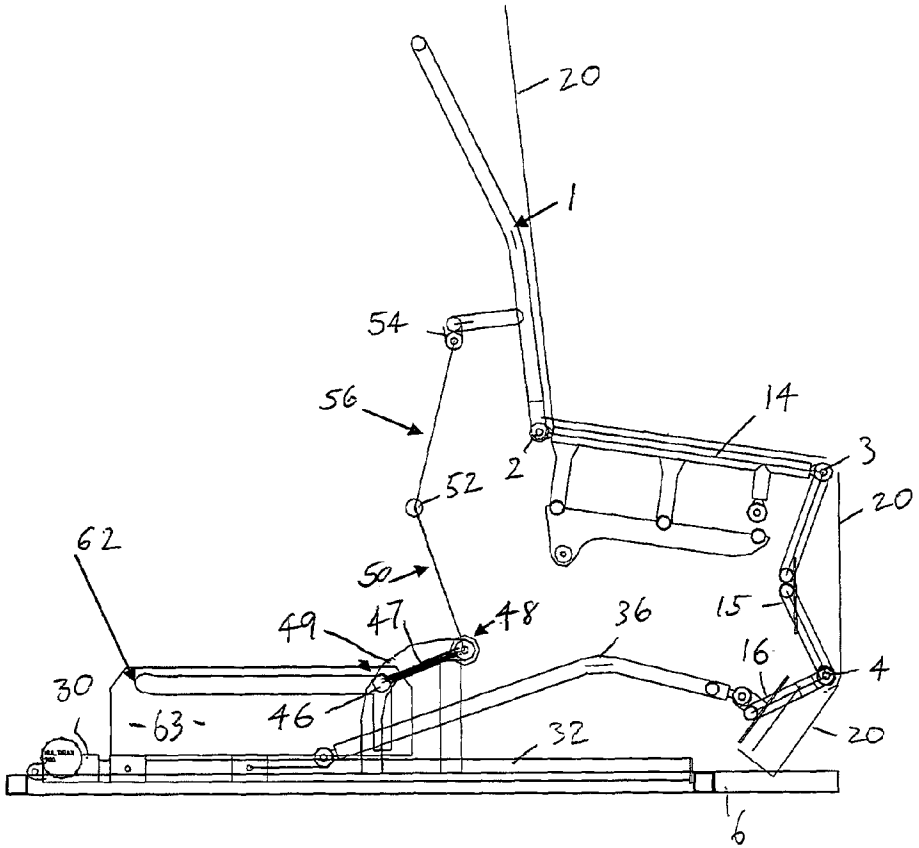
Figure 13:
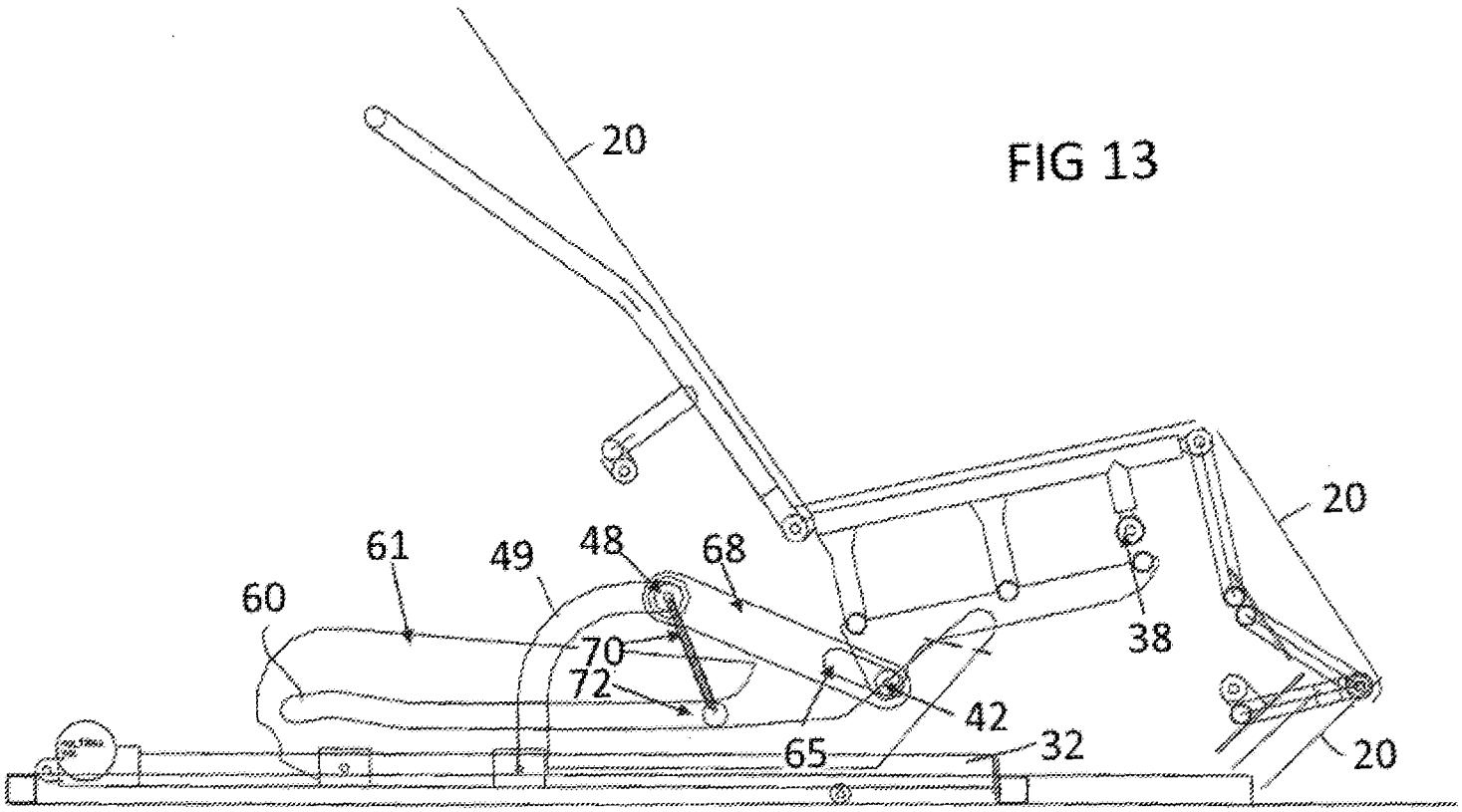
Figure 19:
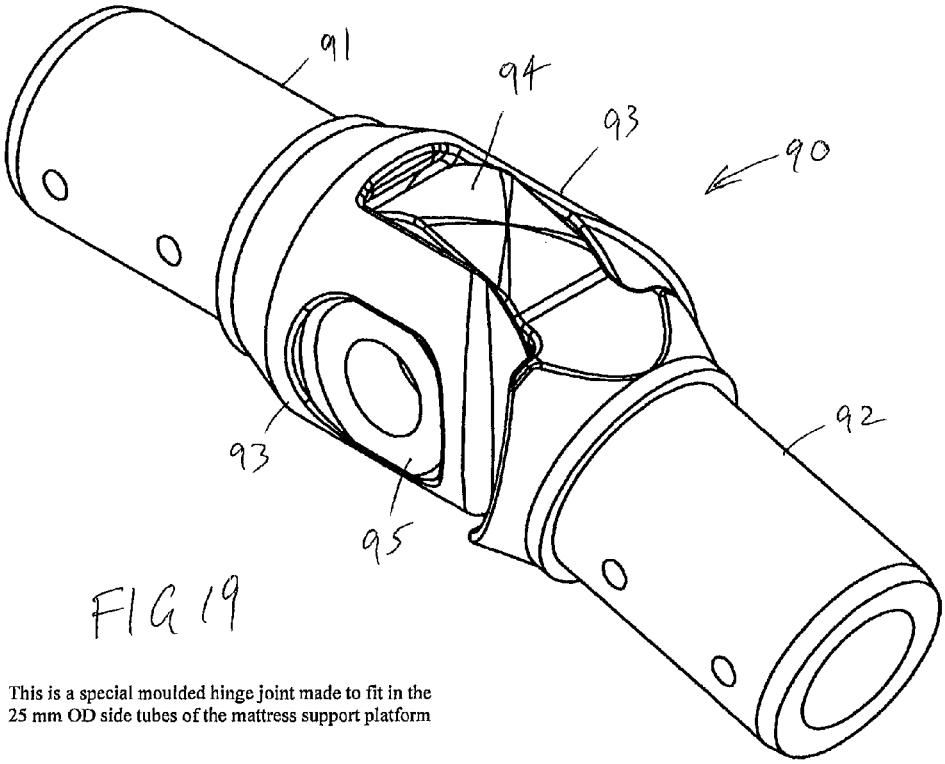
Figure 29:
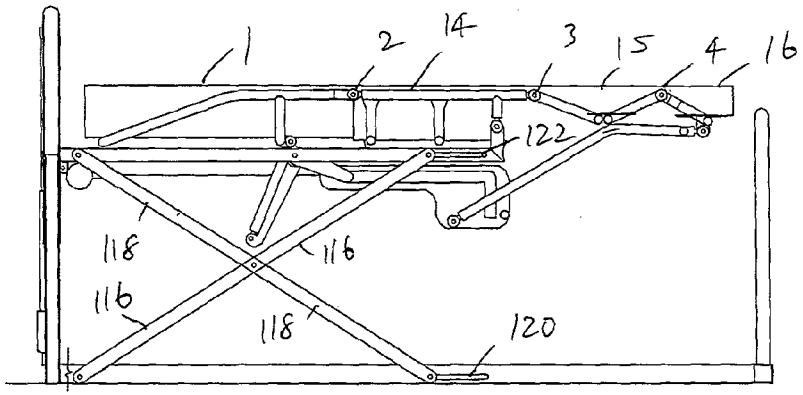
Figure 30:
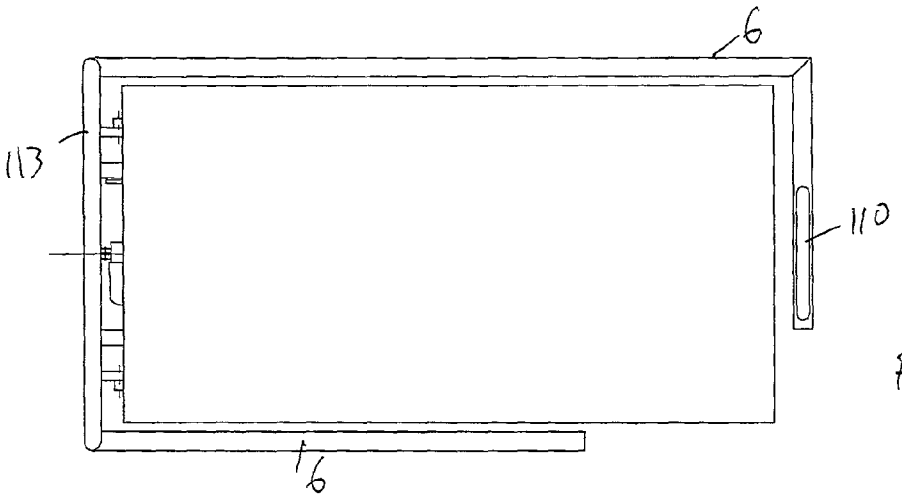
Figure 28:
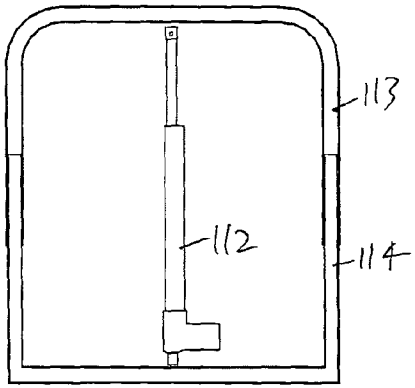

FIGS. 25-30 illustrate a further embodiment which uses a different mechanism for raising and lowering the support surface relative to base frame 6. FIGS. 24-27 show the bed chair apparatus of this embodiment in a lowered position, and FIGS. 28-30 show the bed chair apparatus of this embodiment in a raised position. The carriage structure used is described with reference to FIGS. 14-18, but with the exception that the actuator 30 and plates 61 and 63 are upside down in this embodiment. The base frame 6 extends around to the front of the apparatus so that a handrail 110 can be supported. This arrangement of the base frame 6 also improves stability to assist in preventing the apparatus from overbalancing. A further actuator 112 is connected between the base and a frame member 113 which telescopes over upright frame member 114. Frame member 113 is connected to frame part 115 (comprising part of the base frame of previous embodiments) which is in turn connected to base 6 by scissor members 116 and 118 which ensure that the frame 115 maintains a level orientation with respect to the base 6 during up and down movement. Slots 120 and 122 facilitate operation of the scissor arms 116 and 118. As will be apparent to a person skilled in the art, a handrail can be extended about the perimeter of the apparatus around which the frame 6 extends. The frame can extend around the side of the apparatus opposite to that shown to provide a handrail arrangement that allows left hand or right entry to the apparatus. As an alternative to the extended frame 6 illustrated, a shorter frame 6 can be used but with a separate carriage assembly which extends from frame 6 as the apparatus articulates to the bed configuration (as with embodiments described above) to thereby prevent overbalancing.

Figure 31:
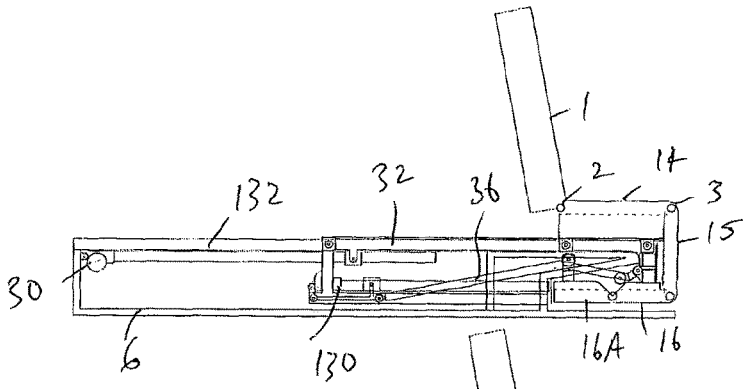

Another embodiment which is suitable for bariatric patients is shown in FIGS. 31-35. In this embodiment the foot section 16 is extended and split into two sections referenced 16 and 16A which are pivotally connected at pivot point 4A. The base frame 6 supports a carriage 32 that is slideably mounted on the frame 6 and is moved relative to frame 6 by an actuator 30. Carriage 32 slides in a track 132 in the base frame 6. The seat section 14 is connected to the carriage 32, so the seat section moves back and forth with the carriage, and when articulating to the bed configuration pulls the leg rest 15 and foot rest sections 16 and 16A on to the base frame for support. The track 132 can support wheels or rollers 133 and 134 of the two foot sections 16 and 16A. Carriage 32 has a further actuator 130 to which foot section control arm 36 is pivotally connected. As can be seen in FIG. 31, in the chair configuration the carriage 32 is fully extended, and the further actuator 130 has arm 36 fully retracted so that the foot section 16 is folded tightly under the foot end of frame 6 and under the seat section 14. To articulate the apparatus to the bed configuration the carriage 32 is drawn away from the foot end (i.e. the carriage 32 is retracted), while the arm 36 is extended (i.e. arm 36 moves in the opposite direction to carriage 32).

Figure 32:
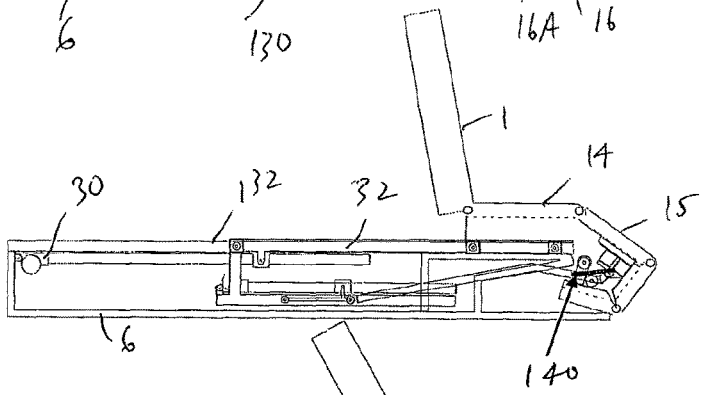
Figure 33:
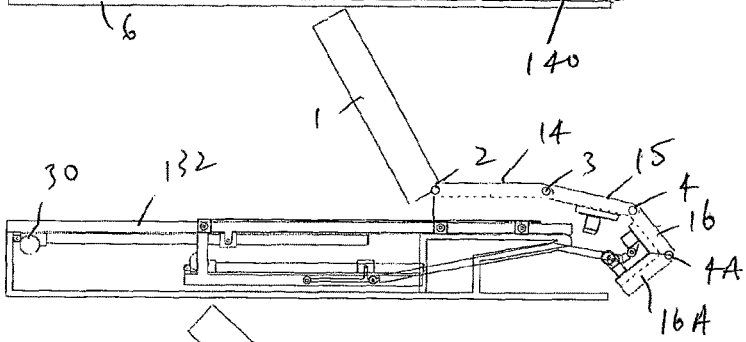
Figure 34:
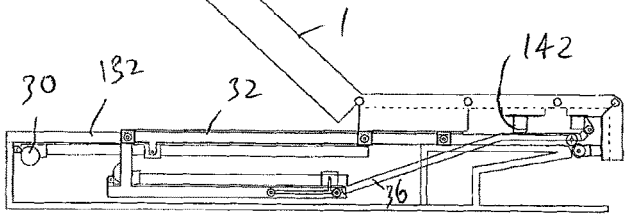
Figure 35:
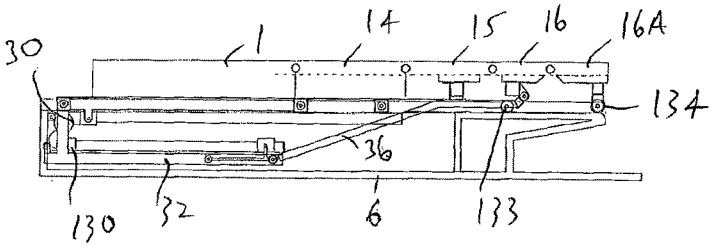
Figure 38:
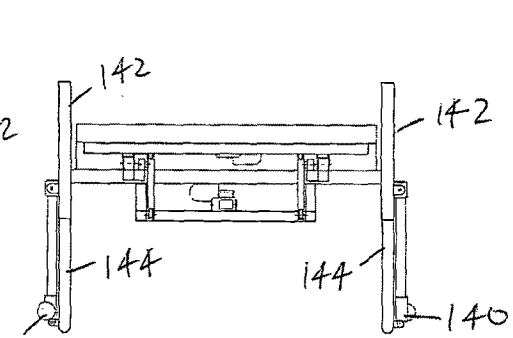
Figure 37:
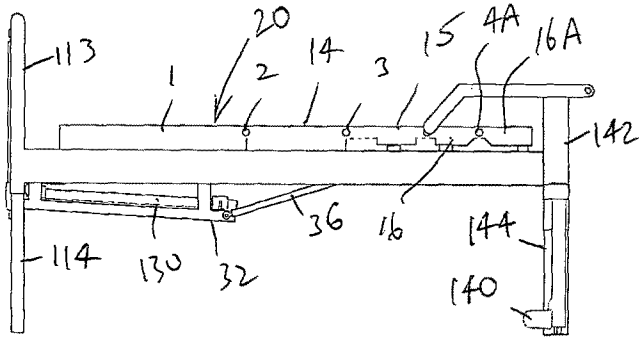
Figure 39:
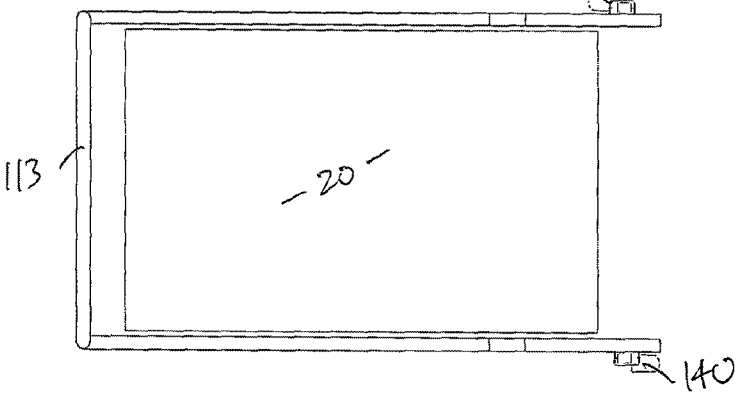
Figure 36:
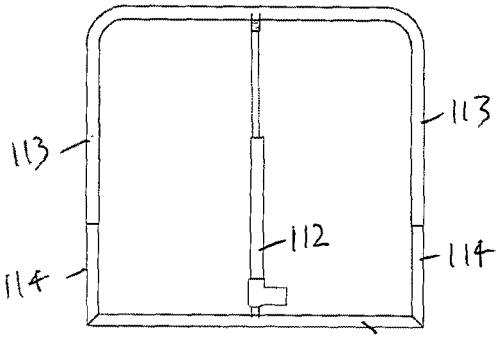
Figure 40:
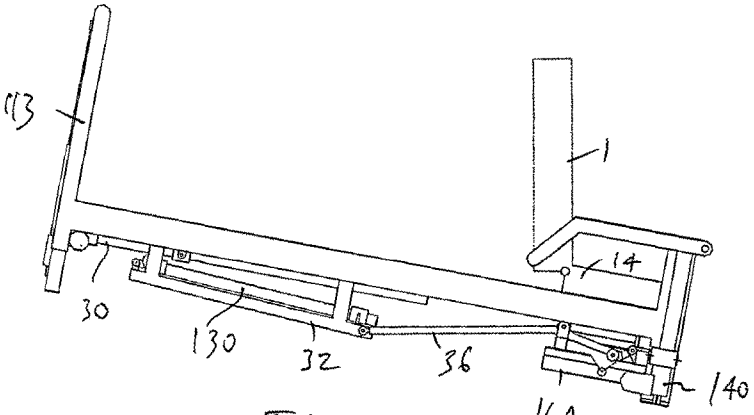
Figure 42:
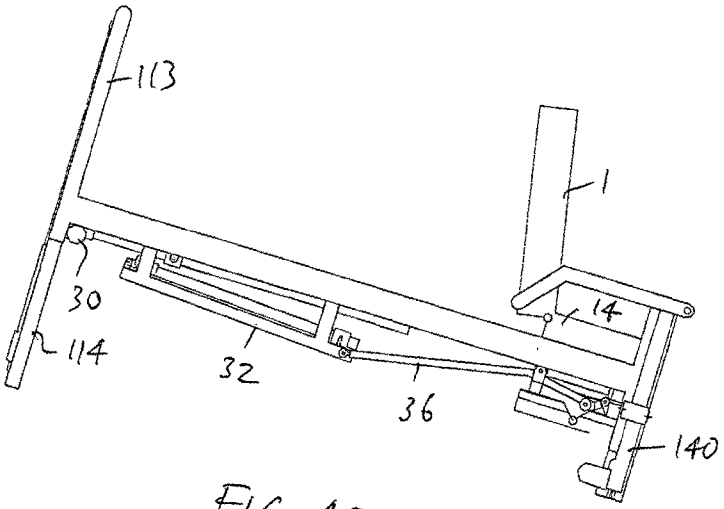
Figure 41:
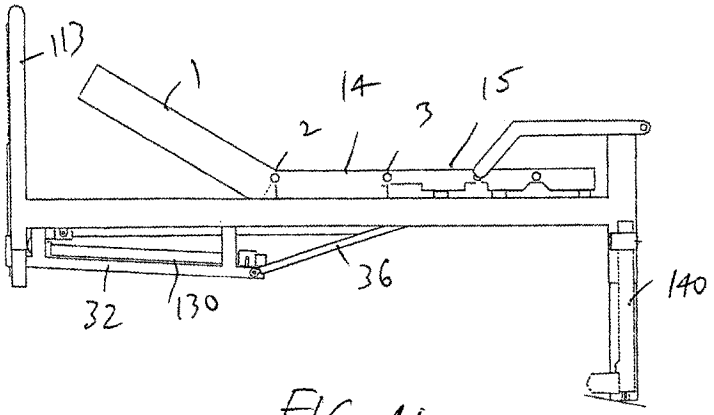

Referring to FIG. 32, the foot sections 16 and 16A are connected by a biasing device such as coil spring 140 to hold them in a folded orientation during initial stage of the articulation from the chair to bed configuration, and during the final stage of the articulation from the bed to chair configuration. Referring to FIGS. 33 to 35 it can be seen that the control arm 36 is contoured or otherwise configured to support the base 142 of leg section 15 to thus assist in supporting the additional loads necessary for bariatric users. The foot sections 16 and 16A are supported by wheel 133 and 134 engaging with tracks 132 in the support frame. The frame 6 directly supports each section of the user support surface when the apparatus is in the bed configuration.

Those skilled in the art will appreciate that the height adjustment mechanism described and illustrated with respect to FIGS. 25-30 may be used to provide controlled height adjustment for the embodiment described above with respect to FIGS. 31-35. Another height adjustment mechanism for the embodiment of FIGS. 31-35 is shown in FIGS. 36-42. Referring to those Figures, actuator 112 controls the height of the head end of the apparatus as described above. Further actuators 140 are provided at the foot end of the apparatus to control the height at that end. Frame parts 142 and 144 telescope relative to each other to provide structural integrity while allowing the height to vary. As a further alternative (not shown) an actuator may be provided at each corner of the apparatus, again using telescopic frame members as described above. In this way the apparatus may be adjusted in height to provide an angle in a transverse direction (i.e. from side to side) as well as the longitudinal angle shown in FIGS. 41 and 42.

A further embodiment of a bed chair suitable for bariatric purposes is shown in FIGS. 43-46. Referring to those Figures, features like those described in other embodiments above have been assigned like reference numerals. A new feature in this embodiment is backrest link 56 being able to telescope so that it has an adjustable length. This allows allow adjustment to accommodate the angle that the user is capable of sitting at in the chair configuration. The apparatus also includes handrails 150 and 151. These may be solid barriers or have a rail structure. In the embodiment shown they telescope, as shown in the hidden detail in the Figures, so that they provide a continuous barrier when the apparatus is in either configuration, and when the apparatus is articulating between configurations. This embodiment also includes a suspension member 154 extending from the footrest link 36. In the example illustrated this is provided in the form of a coil spring, but other arrangements may be used. The spring 154 may be retained in position using a link such as strut 155. In use, the suspension member 154 provides some flexion in the leg section to provide greater comfort to users with heavy legs. This embodiment also includes an optional inner slide sheet mattress referenced 156. Mattress 156 is formed from a tube of material which has a low co-efficient of friction so that it can slide on itself easily. On the outside of the tube a tin layer of cushioning material is provided. The overall effect is to form a thin mattress which allows a user to slide relative to the bed. The mattress 156 is held onto the underlying mattress structure (or to another part of the bed chair structure) by an elastic arrangement, such as strips of elastic material. Mattress 156 facilitates users, especially bariatric users, rolling over in the apparatus as it assists in overcoming shear forces between the user and the existing structure.

Those skilled in the art will appreciate that the present invention provides apparatus that have a number of advantages, including:

A leg rest or foot rest that folds under the seat. This feature ensures that when the leg rest or foot rest is unfolded into the lie flat position that there is enough length of leg rest to support the feet of the user.

The compact design and low positioning of the actuators and levers means that in some embodiments the mattress can go as low as 170 mm to the base frame and 300 mm overall to the top of the mattress when in the chair profile and also when in the bed profile. In some embodiments the average maximum height overall to the top of the mattress is 900 mm. This compares with known profiling beds which typically have a variance between minimum and maximum height of 400-500 mm. The present invention has a variance of 600 mm in some embodiments.

Manual or powered actuation is possible, and in some embodiments a single actuator may be used to convert the apparatus between the bed and chair-like configurations.

A seat panel is provided which can be manually adjusted in depth to enable the seat pan to be deeper or shallower to suit the user.

In some embodiments the apparatus can be provided as a standard profiling bed without the fold under function of the leg or foot rest. The benefit to the user is that this provides a powered bed that will go very low. In this configuration a leg lifter which includes a flexible support arm as described above can be optionally added to the side of the bed if required.

The embodiments described are easily strengthened by thickening the wall size of the steel frame and adding additional actuators or upgrading the actuator motor size to suit the needs of overweight users.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the spirit or scope of the appended claims.

The invention claimed is:

1. A bed chair apparatus including:

a frame;

a user support surface supported by the frame, the user support surface including a backrest section, a seat section, a leg section, and a foot section that are arranged longitudinally and configured to articulate relative to each other whereby the user support surface is configurable in a bed configuration in which the support surface is substantially flat, and in a chair configuration; and at least one profile member having a contoured surface and a follower which is guided by the contoured surface whereby movement of at least one of the backrest section or the seat section relative to the frame is dependent on the contour of the contoured surface, and, wherein the seat section is movable pivotally during articulation to allow the foot section to fold under the seat section.

2. A bed chair apparatus as claimed in claim 1 wherein the backrest section articulates independently of the seat section.

3. The bed chair apparatus of claim 1 wherein the profile member is provided on the frame.

4. The bed chair apparatus of claim 1 wherein the follower is connected by a link to the backrest section or the seat section.

5. The bed chair apparatus of claim 1 wherein the profile member is provided to control movement of the backrest section relative to the frame, and a further profile member is provided to control movement of the seat section relative to the frame.

6. The bed chair apparatus of claim 1 further including a biasing means to maintain the follower in contact with the contoured surface.

7. The bed chair apparatus of claim 1 wherein the contoured surface is provided in a slot in the profile member.

8. A bed chair apparatus as claimed in claim 1, wherein the leg section is only connected to the frame via pivotal connection to the seat section and the foot section.

9. A bed chair apparatus as claimed in claim 8, further including:

a link between the frame and the foot section to move the foot section between the bed configuration and the chair configuration, wherein the link supports the leg section when the apparatus is in the bed configuration.

10. A bed chair apparatus as claimed in claim 9, further including:

a stop member which stops movement of the link in at least one direction as the apparatus articulates from the bed configuration to the chair configuration.

11. A bed chair apparatus as claimed in claim 9 wherein the stop member redirects movement of the link to articulate the foot section relative to the leg section.

12. A bed chair apparatus as claimed in claim 8, wherein during articulation from the chair configuration to the bed configuration the leg section commences articulation prior to the foot section.

13. A bed chair apparatus as claimed in claim 8, further including an articulation apparatus provided between the frame and the support surface whereby the seat section may be raised or lowered relative to the base frame.

14. A bed chair apparatus as claimed in claim 13 wherein the seat section is raised during articulation and lowered once the foot section has been disposed beneath the seat section.

15. A bed chair apparatus as claimed in claim 1, wherein, the foot section unfolds and extends to provide an extended leg support region in the bed configuration, where the unfolded foot section extends a length of the leg section by a length greater than a height of a front edge of the seat section when the apparatus is in the chair configuration.

16. A bed chair apparatus comprising:

a frame;

user support surface supported by the frame, the user support surface being comprised of plural sections pivotally connected to each other at pivot connections, the plural sections including a backrest section, a seat section, a leg section, and a foot section arranged longitudinally and articulable relative to each other, wherein through articulation, the user support surface is configurable into a bed configuration in which the user support surface is substantially flat, and in a chair configuration; and at least one profile member having a contoured surface and a follower that control the articulation, the follower being guided by the contoured surface whereby movement of at least one of the backrest section or the seat section relative to the frame is dependent on the contour of the contoured surface, and wherein the seat section is movable pivotally during the articulation of the user support surface to move the foot section to fold under the seat section, by folding back and upwardly under the seat section, when the user support surface is moved into the chair configuration.

17. A bed chair apparatus as claimed in claim 16, wherein, the foot section unfolds and extends to provide an extended leg support region in the bed configuration, where the unfolded foot section extends a length of the leg section by a length greater than a height of a front edge of the seat section when the apparatus is in the chair configuration.

* * * * *